United States Patent [19]

Pearce et al.

[11] 3,978,705

[45] Sept. 7, 1976

[54] METHOD AND APPARATUS FOR THE MANUFACTURE OF A THIN SHEET ORIFICE PLATE

[75] Inventors: Larry N. Pearce, Oak Park; Arthur E. Neumann, Winnetka; Ralph K. Wyssling, Glenview, all of Ill.

[73] Assignee: Cotton Incorporated, New York, N.Y.

[22] Filed: Mar. 14, 1975

[21] Appl. No.: 558,237

[52] U.S. Cl. ..... 72/325; 72/327; 72/466; 83/660

[51] Int. Cl.[2] ..... B21D 31/02

[58] Field of Search ..... 72/325, 326, 327, 339, 72/464, 466, 465, 57, 420, DIG. 14; 83/30, 660, 684; 269/55, 58, 71, 74, 77, 67; 239/567, 601; 113/1 F, 116 V, 116 R, 121 R

[56] References Cited

UNITED STATES PATENTS

| | | | |
|---|---|---|---|
| 1,675,910 | 7/1928 | Riker | 72/325 |
| 2,732,259 | 1/1956 | Sebald | 239/601 |
| 2,898,788 | 8/1959 | Baxa | 72/465 X |
| 3,380,322 | 4/1968 | Brault | 269/67 |

*Primary Examiner*—James R. Duzan
*Attorney, Agent, or Firm*—Burns, Doane, Swecker & Mathis

[57] ABSTRACT

A thin sheet metal orifice plate is disclosed having at least one orifice therethrough with a rounded inlet to improve flow and an outlet defined by an encircling projection whose axis accurately conforms to a predetermined direction. Apparatus for the production of such an orifice plate is disclosed and includes a forming tool operable to form a spherical boss in a flat intermittently advanced thin metal sheet of orifice blank material. The apparatus includes an orifice plate blank trimming tool having a punch and die assembly for accurately trimming the spherical boss from a continuous strip such that an annular flange is provided therearound. An orifice punching apparatus is provided having a chuck for holding an orifice plate blank adjacent to a resilient backing material. The chuck is supported by an angular adjustment apparatus which, in turn, is rotatably supported on a base and provided with a pair of detent mechanisms. The detent mechanisms secure the angular position of the adjustment apparatus. A horizontally reciprocable punch is aligned with its longitudinal axis passing through a locus of curvature of an orifice blank when carried by the chuck. The punch is provided with a vertical adjustment apparatus to locate the punch with respect to the orifice plate blank and a punch penetration adjustment to stop the reciprocable movement of the punch at a predetermined point while determining the diameter of the orifice punched.

21 Claims, 21 Drawing Figures

METHOD AND APPARATUS FOR THE MANUFACTURE OF A THIN SHEET ORIFICE PLATE

BACKGROUND OF THE INVENTION

This invention relates generally to a thin sheet orifice plate and a manufacture thereof. More specifically, this invention concerns the apparatus and method for fabricating a thin sheet orifice plate having orifices in a predetermined pattern with axes accurately conforming to predetermined directions and having rounded inlets.

The design and manufacture of thin sheet orifice plates is of importance in many spraying applications and of particular importance when the orifice plate distributes material in a plane perpendicular to direction of flow of material through the orifice plate. In the latter spraying applications, it is frequently necessary to accurately predict or determine spray coverage. Important characteristics of spray coverage are density and uniformity of material distribution and droplet size and uniformity thereof.

Density and uniformity of material distribution are characteristics related not only to the flow rate of material through the orifices but also to the direction which streams of droplets emanate from the orifices. Thus, it is apparent that flow rates and stream directions must be capable of accurate determination. The characteristics of droplet size and uniformity are also significant since they deal with the susceptibility of the spray to random cross-currents of wind, among other things.

Uniformly sized droplets, accurately predetermined directions and flow rates require that each orifice in a nozzle plate has a uniform, predetermined outlet diameter and a predetermined flow direction and volumetric flow rate. Given these characteristics desired spray coverage requirements may be attained by properly selecting the number of orifice holes and the pattern of such holes in an orifice plate.

In the past it has been known to drill orifice holes individually. However, when dealing with thin plates, for example having a thickness on the order of 0.005 inches, drilling does not provide a satisfactory technique. More specifically, it is known not only that drills frequently break and distort an orifice plate but also that the axis of a drilled hole frequently meanders thereby directing a flow of fluid out of a target area. Other problems relating to the use of drilled holes include the fact that the holes were not round and that one or more burrs were frequently left at the exit from the orifice. To even partially overcome problems of the type noted, the drilling process necessarily proceeded slowly thus adding substantially to the cost of orifice plates fabricated thereby.

Aside from the problems associated with the manufacture of orifice plates having drilled holes therethrough, additional problems arise when such orifice plates are placed into use. For example, the inability to precisely control the axis of each orifice caused unpredictable stream performance insofar as obtaining coverage in a given target area is concerned. In addition, non-uniform cross-sectional areas and sharp edged inlets led to excessive erosion of each orifice passage after short periods of use thereby destroying accuracy of flow rate estimations. Furthermore, in the presence of burrs the direction of a given stream frequently would shift erratically and generate smaller non-uniform droplets or satellites.

Another difficulty with previously known thin orifice plates concerns the propensity of small diameter orifices to clog. Such clogging is not only difficult to avoid but also adversely affects the uniformity of material distribution. Since the known thin orifice plates have been expensive to manufacture, a great reluctance to readily discard clogged orifice plates is manifested by the users.

One method of eliminating a portion of the problems related to drilled orifice holes is to use an orifice plate which is substantially thicker than the thin sheet orifice plate to be described herein. Such an approach, however, suffers from undesirably high expense for not only the plate, but also for the labor involved in manufacturing the relatively longer orifices. It is also noted that a large number of small orifices will provide a more uniform spray overage than will a small number of large orifices such as may be necessary with thicker orifice plates.

In the past, it has also been known to use punches and dies to manufacture orifice openings in orifice plates. Conventionally, however, the concept of using a punch to fabricate orifice openings in a thin sheet orifice plate blank has generally been found to be unacceptable. For example, as the punch engages the material surface, the entire sheet may be deformed and stressed until the punch penetrates the material. It should be readily apparent that such a process can lead to permanent deformations and weakened orifice plates due to excessive and repeated stresses. Such permanent deformations destroy the utility of the product by eliminating whatever control previously existed over the direction and size of the orifices.

OBJECTS AND SUMMARY OF THE INVENTION

Accordingly, it is a general object of the present invention to provide a novel orifice plate having orifices which accurately conform to predetermined directions and which are substantially free from wear for extended periods of operation.

A more specific object of the present invention is to provide a novel orifice plate fabricated from a thin sheet of metal such that each orifice has a rounded inlet and an encircling projection providing stability to the direction of a fluid stream leaving the outlet.

Another object of the present invention is to provide an inexpensive disposable orifice plate fabricated from stainless steel shim stock.

Yet another object of the present invention is to provide a thin metal orifice plate in which precise control of manufacturing tolerances is possible thereby insuring that flow control, direction, and capacity can be accurately provided.

Yet a further object of the present invention is to provide a novel thin metal orifice plate having a substantially increased useful life.

Yet another object of the present invention is to provide a novel method of fabricating a thin sheet orifice plate having orifices with axes accurately conforming to predetermined directions and having rounded inlets thereto.

A further object of the present invention is to provide a novel apparatus for punching orifice holes in a metal orifice plate having a thickness in the range of 0.001 to 0.010 inches.

It is a still further object of the present invention to provide a novel method and apparatus for producing a thin metal orifice plate in which each orifice is punched through an orifice plate blank while the blank is supported by a resilient member that is effective to localize stresses otherwise tending to deform the orifice plate blank.

Apparatus which is substantially intended to satisfy at least some of the objects set forth above includes a base and chuck apparatus for securely holding an orifice plate blank having a locus of curvature while orifices are formed therein. A resilient backing member is carried by the chuck apparatus and is positioned adjacent to the orifice plate blank to localize stresses in the orifice plate blank as individual orifices are formed therein.

The base is provided with a rotatably carried angular adjustment apparatus having a rotational axis and supporting the chuck means. The rotational axis passes through the locus of curvature of an orifice plate blank carried by the chuck apparatus. The angular adjustment apparatus is operable to angularly position the chuck apparatus while individual orifices are formed therein.

The base is also provided with punch apparatus which is mounted thereon and which has a longitudinal axis that may be positioned to simultaneously pass through both the rotational axis of the angular adjustment means and the locus of curvature of the blank. In this manner, the punch apparatus is operable to radially pierce an orifice plate blank carried by the chuck apparatus. The punch apparatus may also be provided with a vertical adjustment mechanism that is operable to position the punch apparatus vertically with respect to the chuck apparatus and the orifice plate blank carried thereby.

In addition, the punch apparatus may include a penetration adjustment mechanism disposed at one end portion thereof. The penetration adjustment mechanism is operable to control the depth to which the punch means projects into an orifice plate blank. Especially when used with a conical punch tool, the penetration adjustment mechanism is operable to predetermining the diameter of an orifice formed by the punch apparatus.

In a preferred embodiment, the angular adjustment apparatus may comprise a wheel having a plurality of gear teeth extending radially outwardly therefrom and having a corresponding plurality of spaces therebetween. The wheel may be rotatably mounted on the base and may have the chuck apparatus mounted thereon.

To positively position the wheel in a given angular position, a first radially oriented detent is mounted on the base and is selectively engageable with peripheral spaces of the wheel. The first detent is operable to retain the chuck apparatus in a plurality of angular positions with respect to the punching means.

The angular adjustment apparatus may further include a second radially oriented detent which is mounted on the base but which is angularly spaced from the first detent. In order to provide a second plurality of angular positions each of which is interposed between angular positions provided by the first detent, the second radially oriented detent may be angularly spaced from the first detent by an angle corresponding to one half of the central angle subtended by an even number of gear teeth.

By fabricating a thin metal orifice plate with the apparatus as described above, an orifice plate having a compoundly curved shape may be obtained in which each individual orifice has an accurately controlled diameter and an accurately controlled direction. The orifice plate will typically include a compoundly curved body portion in which generally circular orifices are provided with a rounded inlet on a concave surface for reducing fluid cavitation and which are provided with an outlet having an encircling projection extending radially outwardly from the convex surface for directing a stream of fluid from the orifice. In addition, the orifice plate will typically include mounting device disposed around the periphery of the body portion and being operable to position and retain the body portion in suitable apparatus for use.

The orifice plate may include two rows of uniformly spaced orifices which subtend an arc in the body portion corresponding to the desired angular dispersion of fluid to be distributed through the orifice plate. If desired, the two rows of orifices may be staggered with respect to one another.

To fabricate an orifice plate with the apparatus as described, an orifice plate blank is first positioned in a holding fixture which facilitates directional control of orifice axes. Subsequently, the holding fixture is mounted in a jig that is rotatable about an axis that intersects a center of curvature of the orifice plate blank. Each orifice is provided with a rounded entrance and an axis accurately conforming with a predetermined direction by extruding an opening in the orifice plate blank as a punch is transversely extended through the rotational axis and through the orifice plate blank while it is resiliently supported. Subsequently, the punch is withdrawn from engagement with the orifice blank leaving the completed orifice. To provide a plurality of orifices in a single orifice sheet, the jig is repositioned to align the punch with the next desired location and the extruding and withdrawing operations are repeated until a predetermined hold pattern has been obtained.

DESCRIPTION OF THE DRAWINGS

The above and many other objects of the present invention will be apparent to those skilled in the art when this specification is read in conjunction with the accompanying drawings wherein like reference numerals have been applied to like elements and wherein.

DESCRIPTION OF THE PREFERRED EMBODIMENTS

To manufacture an orifice plate in accordance with the present invention, an orifice plate blank must be provided. A suitable orifice plate blank may be obtained by using a flat strip of sheet metal stock which is given a simple curvature. Alternately, a compoundly curved orifice plate blank may be used. Suitable apparatus for creating a suitable compoundly curved orifice plate blank may include a forming fixture to form a compoundly curved portion in a sheet of stock material and a trimming fixture to separate a suitably sized compoundly curved orifice plate blank from the sheet of stock material. The orifice plate blank is then positioned in a punching apparatus where a predetermined pattern of orifices is formed.

The forming fixture, the trimming fixture, and the punching apparatus will now be described in detail. Of course, it will be understood that numerous other devices could be substituted for the forming, trimming and punching tools herein described in order to obtain an orifice plate having the desired characteristics.

Figure 1:
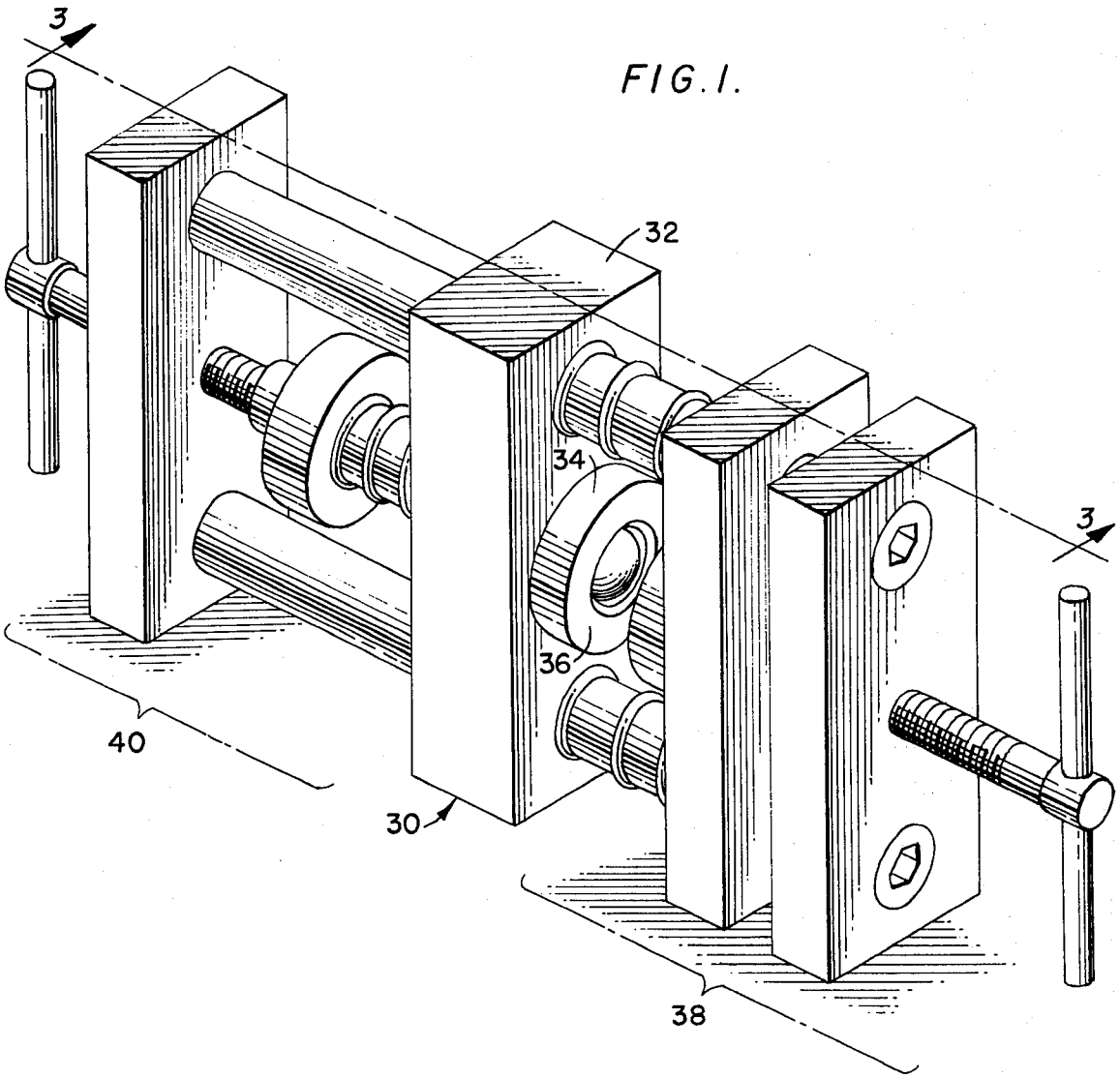
FIG. 1 is an axonometric projection illustrating apparatus for forming spherical bosses in an intermittently fed continuous metal sheet.

Depicted in FIG. 1 is a forming fixture 30 having a centrally located bed member 32 which is provided with a generally cylindrical, outwardly projecting ring 34. The ring 34 includes a substantially planar, annular surface 36 that serves as an abutting surface for a clamping device 38. The bed member 32 is provided with a forming device 40 that is operable from the side opposite the clamping device 38. The forming device 40 is generally aligned with the cylindrical ring 34 of the bed member 32.

The forming fixture 30 of FIG. 1 is designed to produce a spherical projection or boss 42 (see FIG. 2) in a generally continuous thin sheet of metal stock 44 that may be intermittently advanced. The metal stock may be stainless steel, brass, aluminum, or any other metal suitable for use as an orifice plate. Typically, the metal stock has a thickness in the range of 0.001 to 0.010 inches and preferably about 0.005 inches.

Figure 3:
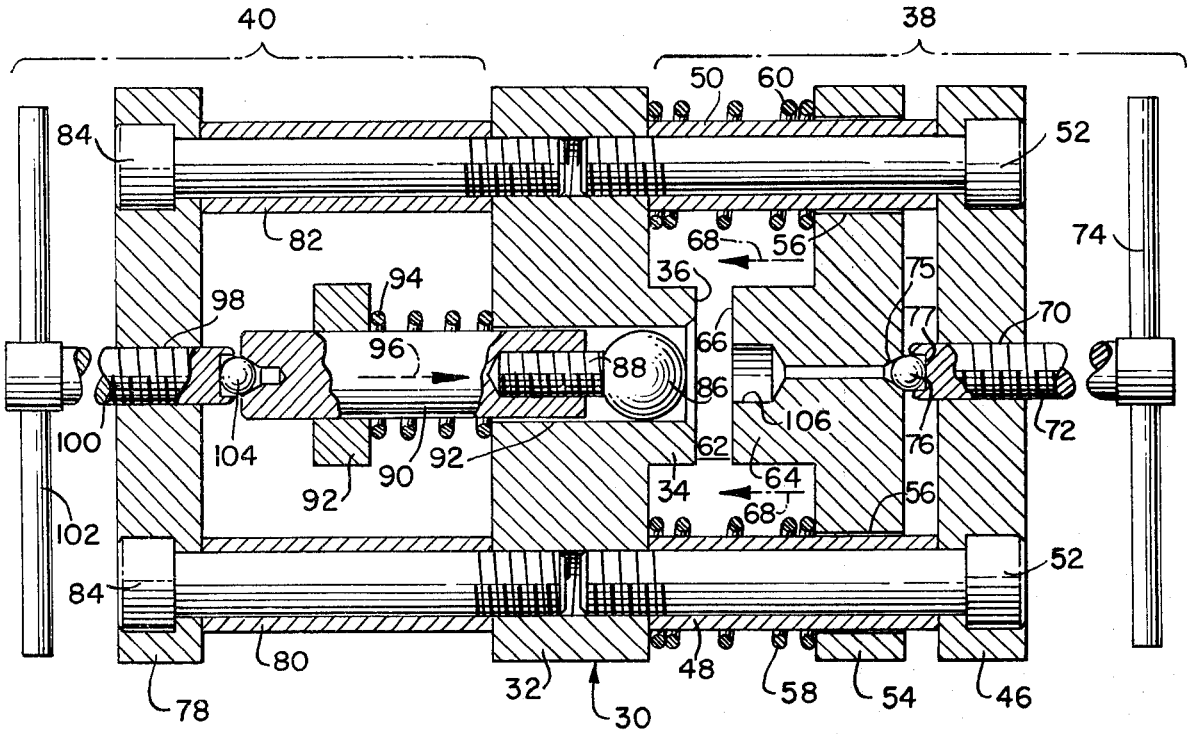
FIG. 3 is a partial cross-sectional view taken along line 3—3 of FIG. 1.

Turning now to FIG. 3, the clamping device 38 includes a first stationary bar 46 which is spaced from the bed member 32 by a pair of generally circularly cylindrical spacer members 48, 50. The stationary bar 46 and the spacer members 48, 50 are connected and positioned relative to the bed member 32 by a pair of bolts 52 that are coaxially disposed within the spacer members 48, 50.

The clamping device 38 also includes a slidably mounted bar 54 having a pair of openings 56 that are slidably mounted about the spacer members 48, 50. Disposed between the slidably mounted bar 54 and the bed member 32 are a pair of symetrically placed compression springs 58, 60. Each spring is circumferentially disposed around a corresponding spacer member 48, 50 and resiliently urges the slidably mounted bar 54 away from the bed member 32. In the above manner a space 62 is normally defined between the cylindrical projection 34 of the bed member 32 and an adjacent coaxial cylindrical projection 64 of the slidable member 54. The cylindrical portion 64 is provided with a generally planar annular surface 66 which is coaxially disposed with respect to the bed member 32 and which is substantially parallel to the annular surface 36.

In order to move the slidably mounted bar 54 in the direction shown by the arrows 68 (see FIG. 3) the stationary bar 46 is provided with a threaded opening 70 which receives a threaded rod 72 having a T-handle 74. A generally cylindrical recess having a flat bottom 77 is provided in an end of the threaded rod 72 such that the recess engages a small spherical ball 76 disposed in a generally conical recess 75 of the slidably mounted bar 54. The spherical ball 76 is thus effective to transmit force to the bar 54 from the rod 72 while accommodating some misalignment therebetween. Accordingly, when the T-handle 74 is rotated to advance the slidably mounted bar 54 in the direction of the arrows 68, the springs 58, 60 are compressed and the annular surface 66 is moved into clamping relationship with the annular surface 36.

The forming device 40 includes a second stationary bar 78 which is disposed on the opposite side of the bed member 32 from the clamping means 38. The stationary bar 78 is mounted on the bed member 32 and is positioned with respect thereto by a pair of spacer members 80, 82. A pair of bolts 84 are coaxially disposed within the spacers 80, 82. Each bolt 84 has an end that is threadably received by the bed member 32 in order to secure the stationary bar 78 in position.

With continued reference to FIG. 3, a forming member 86 having a preselected compound curvature is provided with a projecting threaded stud 88 that is received in the end of a reciprocable shaft 90. The forming member 86 and the shaft 90 are adapted for longitudinal coaxial movement with respect to a bore 92 that is concentrically disposed with respect to the cylindrical projection 34 of the bed member 32.

The forming member 86 may be generally spherical, if desired. However, compound curvature, as used herein, is intended to encompass any geometrical shape having curved cross-section in each of two intersecting perpendicular planes. Thus, prolate spheroids, oblate spheroids, ellipsoids, rotationally symmetric bodies and the like exhibit the characteristic of compound curvature.

The shaft 90 is provided with a collar 92 and a circumferentially disposed compression spring 94 which engages the collar 92 and the bed member 32 and biases the shaft in a direction opposite to the direction indicated by arrow 96, that is, toward a retracted position.

The second stationary bar 78 is provided with a threaded opening 98 which receives a threaded shaft 100 having a T-handle 102 at the outer end thereof. The inner end of shaft 100 is spaced from the end of shaft 90 by a small spherical ball 104. The ball 104 is received by mating recesses of the shaft 100 and the shaft 90 and is effective to accommodate slight misalignment between the threaded shaft 100 and the reciprocable shaft 90. In operation, an appropriate rotation of the T-handle 102 advances the threaded shaft 100 overcoming the bias of spring 94 and moving the shaft 90 and the spherical ball 86 axially in the direction of the arrow 96.

Figure 4:
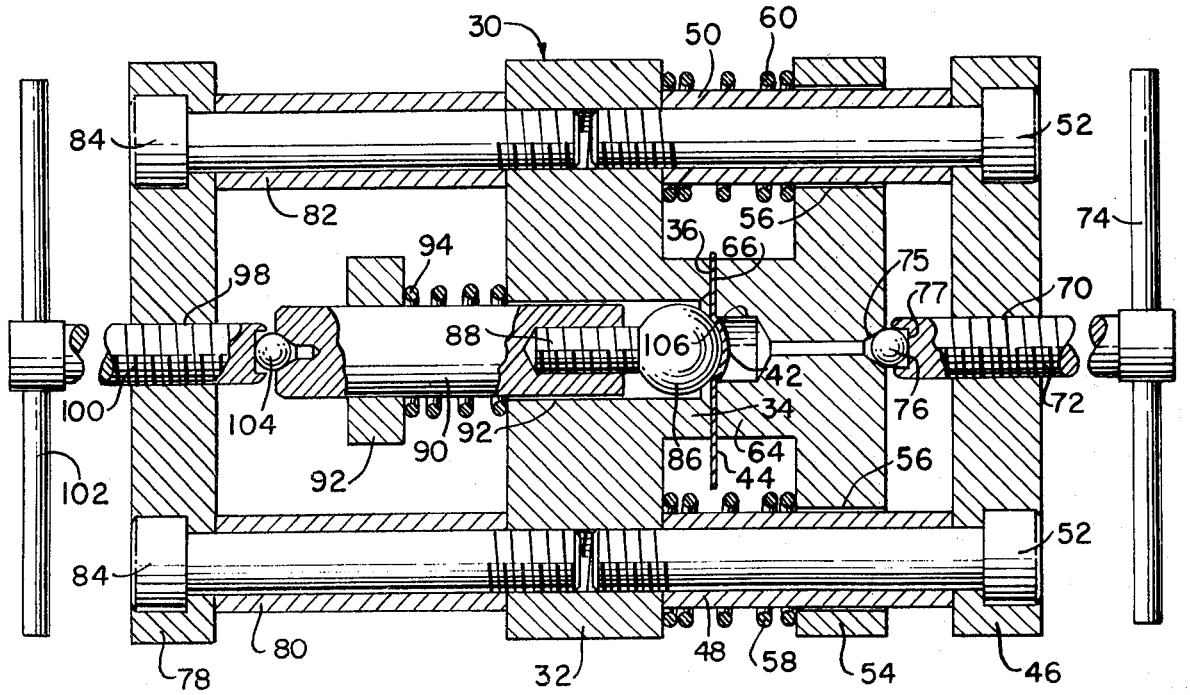
FIG. 4 is a partial cross-sectional view which illustrates the forming apparatus of FIG. 3 with a sheet of material therein at the end of the forming operation.

Turning now to FIG. 4, the forming fixture 30 is illustrated in a closed configuration after the formation of a spherical boss 42 in the thin metal sheet 44. In formation of a spherical boss 42, the thin metal sheet 44 is first clamped between the spaced annular surfaces 36, 66 by appropriately turning the T-handle 74.

Having securely clamped the thin metal sheet 44 the other T-handle 102 is rotated to move the shaft 90 inwardly with respect to the bed member 32 such that the spherical forming member 86 engages and deforms the thin metal sheet 44. The spherical boss 42 thus formed conforms to the peripheral surface of the forming member 86. It will be noted that the slidably mounted member 54 is provided with an enlarged bore 106 which is coaxially disposed with respect to the generally spherical forming member 86. The diameter of the enlarged bore 106 defines the outside perimeter of the generally spherical boss 42.

The T-handles 102 and 74 are then appropriately rotated to allow the forming member 86 and the slidably mounted member 54 to release the thin metal plate 44 so that the thin metal plate may be advanced to form another spherical boss 42.

While the forming fixture 30 has been illustrated with manually operable T-handles as actuation means for the clamping and forming operations, it will be apparent that suitable automated actuation means could be substituted therefor.

It will be noted from FIG. 4 that adjacent spherical bosses 42 on the thin sheet 44 are separated by a distance at least as large as the radial width of the annular surface. Accordingly, appropriate selection of the radial width of the annular surface 66 may be used to limit spacing and to control waste.

Figure 2:
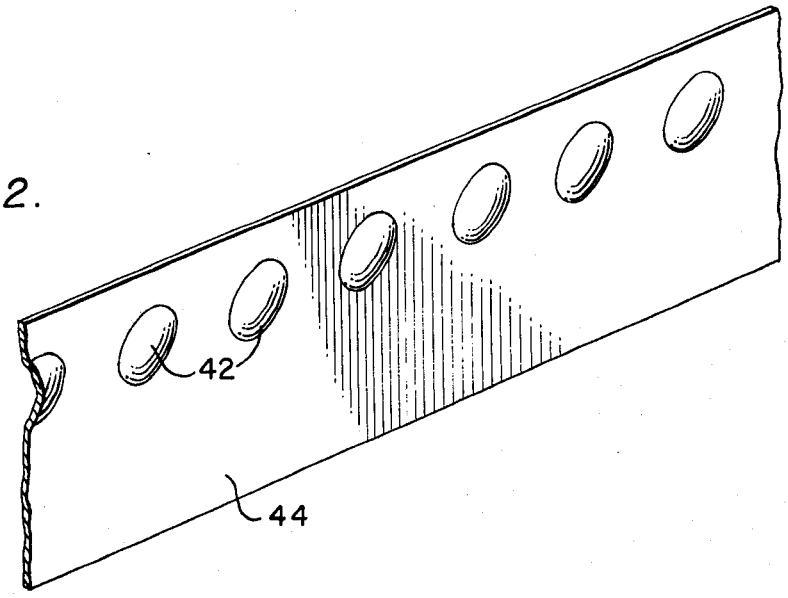
FIG. 2 is an axonometric projection of a sheet of strip stock having a plurality of spherical bosses formed therein.
Figure 5:
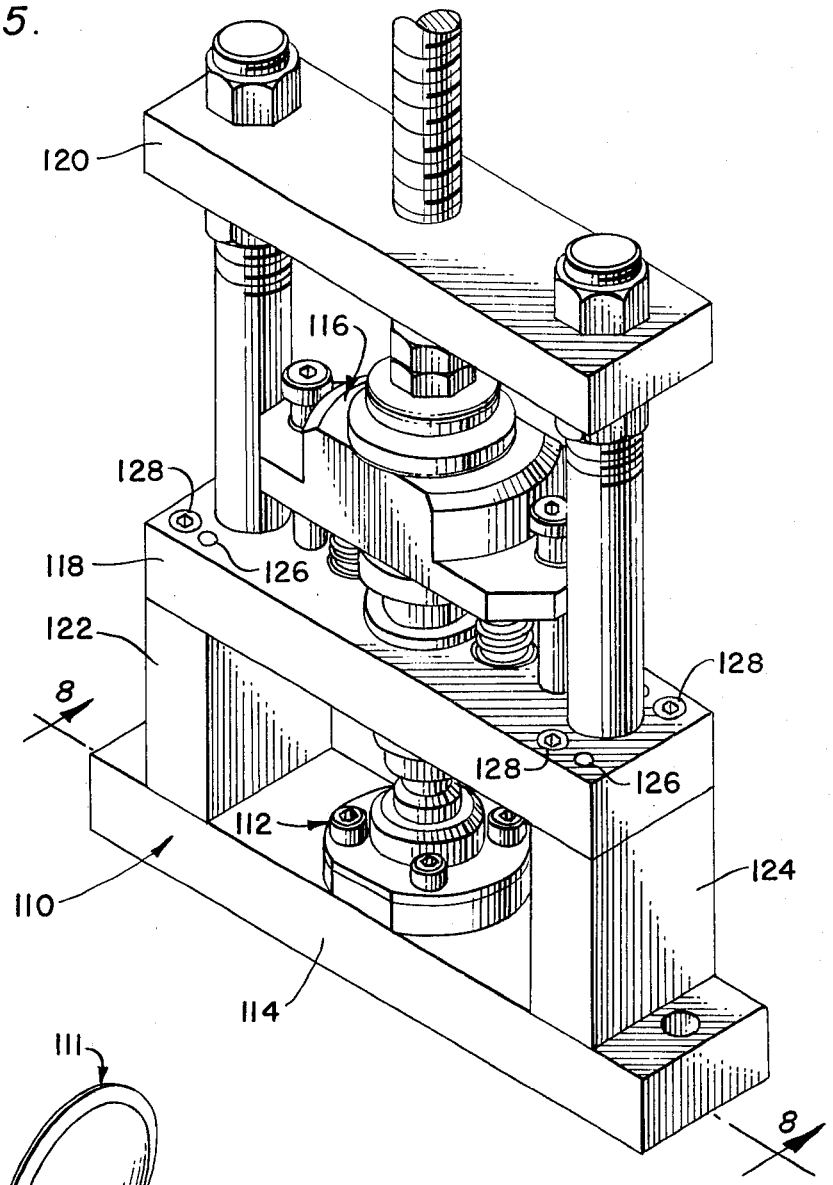
FIG. 5 is an axonometric view of a trimming fixture which removes the spherical bosses from a continuous strip of material.
Figure 6:
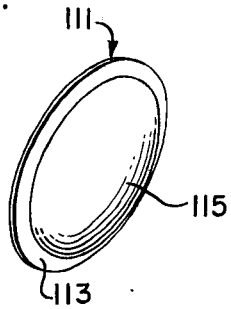
FIG. 6 is an axonometric view illustrating an orifice plate blank after the trimming operation.

A suitable trimming fixture 110 (see FIG. 5) is preferably provided to cut or separate a compoundly curved orifice plate blank 111 (see FIG. 6) from the thin metal strip 44 of FIG. 2. Returning to FIG. 5, the trimming fixture 110 includes a stationary punch assembly 112 which is centrally mounted on a base member 114. Vertically positioned from the punch assembly 112 is a vertically reciprocable die assembly 116 which is maintained in coaxial alignment with the punch assembly 112 by an upper horizontal bar 120 and a lower horizontal bar 118 that are spaced from the base member 114 and from one another.

Figure 7:
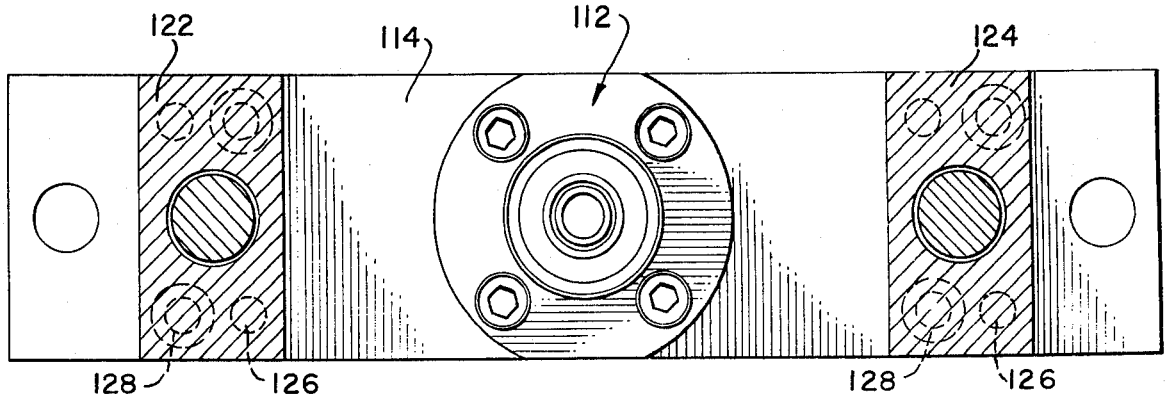
FIG. 7 is a cross-sectional view taken along line 7—7 of FIG. 8.

A pair of spacer blocks 122, 124 are provided to space the lower bar 118 from the base member 114. From FIG. 7, it will be seen that suitable dowels 126 and cap screws 128 are provided to connect the spacer blocks 122, 124 to the base member 114 and the lower horizontal bar 118.

Figure 8:
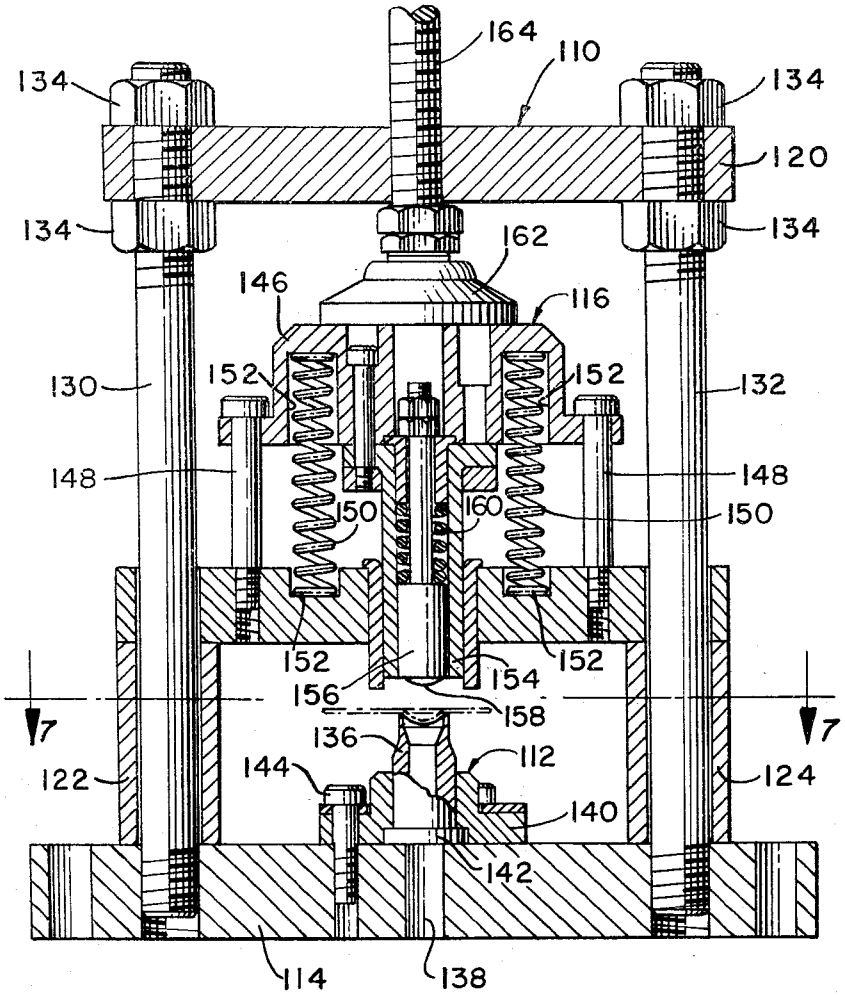
FIG. 8 is a view in partial cross section taken along line 8—8 of FIG. 5.

Turning now to FIG. 8, the upper horizontal bar 120 is spaced from the base member 114 by a pair of shafts 130, 132 which have a threaded end received in a corresponding threaded bore of the base 114. The upper end portion of each shaft 130, 132 is also threaded and is adapted to receive a pair of nuts 134 which cooperate to position the upper horizontal bar 120 with respect to the base member 114.

The stationary punch assembly 112 carried by the base member 114 includes a punch member 136 having a cylindrical stud 138 with a shoulder 142 disposed at the lower end thereof. A suitable collar member 140 is mounted around the punch member 136 and engages the shoulder 142 to position and retain the punch member 136 with respect to the base member 114. The collar 140 may be bolted to the base member 114 by a plurality of threaded bolts 144.

Coaxially disposed with respect to the punch 112 is the reciprocable die assembly 116 that includes a cap 146. A pair of smooth shanked bolts 148 are mounted on the lower bar 118 and guide vertical movement of the cap 146 with respect thereto. A pair of compression springs 150 engage the underside of the cap member 146 and resiliently bias the cap 146 upwardly. The springs 150 are symmetrically disposed with respect to the cap 146 and are received in corresponding aligned recesses 152 of the lower bar 118 and the cap 146.

The cap 146 also includes a generally cylindrical die 154 which is suitably connected to the lower side thereof and which is coaxially aligned with the punch member 136. Slidably mounted within the die member 154 is a plunger 156 having a spherical end portion 158 that generally conforms to the curvature of a boss 42 formed by the forming fixture of FIG. 1.

With continued reference to FIG. 8, the plunger 156 is spring biased downwardly by a compression spring 160 and is adapted to reciprocate independently of the die member 154.

The upper portion of the cap member 146 is attached to a leveling foot 162 which, in turn, is attached to a threaded rod 164 that projects upwardly through the upper horizontal bar 120. The threaded rod 164 may be provided with a suitable T-handle or other conventional means for imparting rotation thereto.

Figure 9:
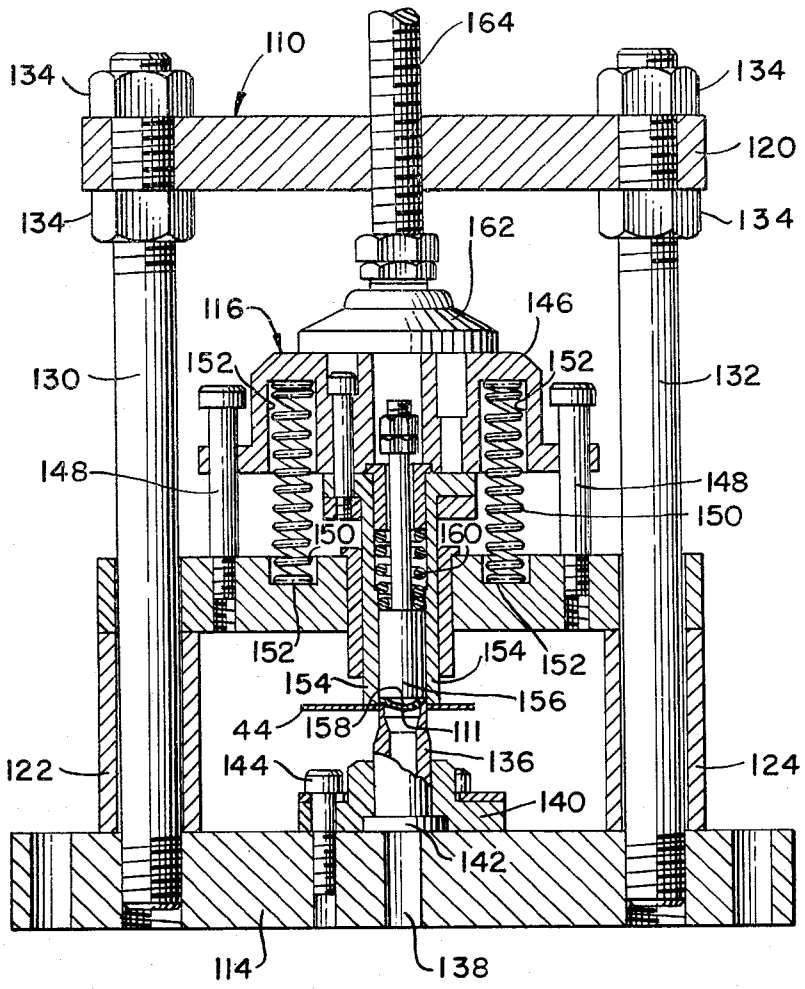
FIG. 9 illustrates the trimming fixture of FIG. 8 in a closed position after having trimmed an orifice plate blank from a continuous strip.

Turning now to FIG. 9, the trimming fixture 110 is illustrated in a position after having trimmed an orifice plate blank 111 from a sheet of metal stock 44 with spherical bosses 42 therein. As the cap 146 and the die member 154 move toward the punch member 136, the spherical portion 158 of the plunger 156 engages a spherical boss and positions the thin metal sheet with respect to the reciprocating die member 154. By virtue of the resilient mounting of the plunger 156, a portion of the thin metal sheet 44 adjacent to a spherical boss is clamped between the plunger 156 and the upper edge of the punch member 136. Continued movement of the cap member 146 toward the punch member causes the cylindrical die member 154 to move vertically downwardly and shear an orifice plate blank 111 from the thin metal sheet 44. The radial width of the upper edge of the punch member 136 may be predetermined to establish a desired circumferential flange 113 (see FIG. 6) circumscribing the periphery of a compoundly curved body portion 115 of each orifice plate blank 111.

Having obtained an orifice plate blank 111, a suitable punching apparatus 170 (see FIG. 10) is provided to form a predetermined pattern of orifices in the orifice plate blank 111. The punching apparatus 170 includes a base 172 having a plurality of suitable leveling feet 171 on the underside thereof and having a shaft receiving opening 173 that is generally circular with two parallel flats as is positioned at a corner of the base.

A holding fixture or chuck assembly 174 is provided to securely hold an orifice plate blank 111 around the peripheral edge thereof while orifices are formed therein and to aid in positioning of the orifices to be formed.

Figure 12:
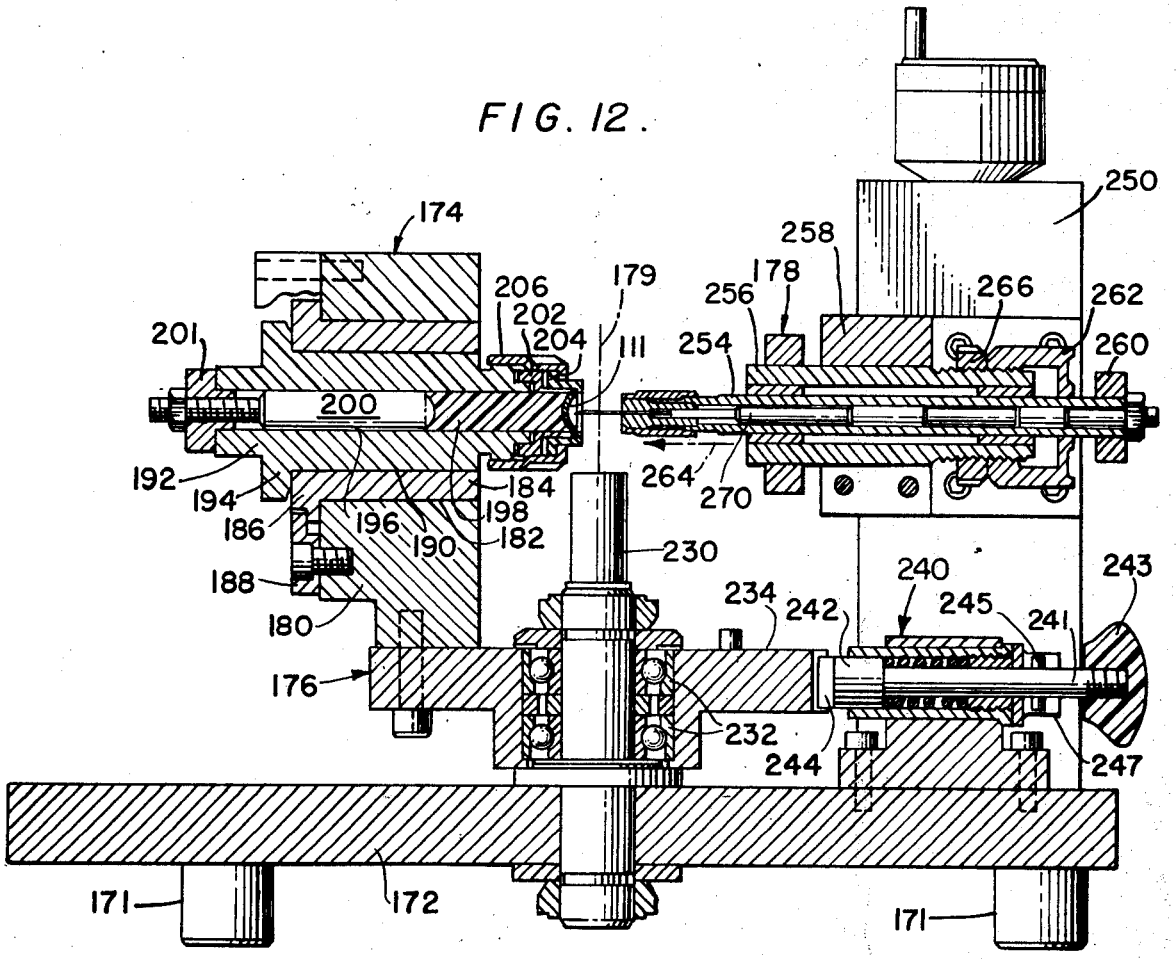
FIG. 12 is a view in partial cross-section taken along line 12—12 of FIG. 11.

A rotatable jig or angular adjustment device 176 is rotatably carried by the base and has a rotational axis 179 (see FIG. 12) which coincides with the locus of curvature of an orifice plate blank 111 carried by the chuck assembly 174. In this manner, movement perpendicularly of the rotational axis 179 will be along a radial line normal to the intersection of the orifice plate blank and a plane containing the direction of movement. It is noted that when dealing with spherical surfaces, radial as used herein is not always synonymous with a true radius of the sphere.

The locus of curvature for a spherical orifice plate blank 111 will, of course, be a point. For other compoundly curved surfaces comprising segments of bodies of revoluation the locus of curvature is a straight line connecting the centers of curvature for the surface. For a simple arcuately curved surface, the locus of curvature is also a straight line.

The chuck assembly 174 is mounted on a portion of the angular adjustment devices 176 which is operable to angularly position the chuck 176 with respect to the base 172.

Returning to FIG. 10, a punch assembly 178 is mounted directly on the base 172 and includes a generally longitudinal axis which passes through the rotational axis 179 and is generally perpendicular thereto. Thus, the punch assembly 178 is operable to radially pierce an orifice blank carried by the chuck assembly as described above. In addition, a vertical adjustment 180 is provided to position the punch vertically with respect to the chuck assembly 174. It will be noted that since the locus of symmetry coincides with the rotational axis 179, the punch will still pierce the blank radially in the sense discussed. A penetration adjustment 182 is provided at the end of the punch means remote from the chuck assembly and is operable to control the depth to which the punch may project into an orifice plate blank 111 and, when a tapered punch is used, to thereby determine the diameter of an orifice formed by the punch.

Figure 11:
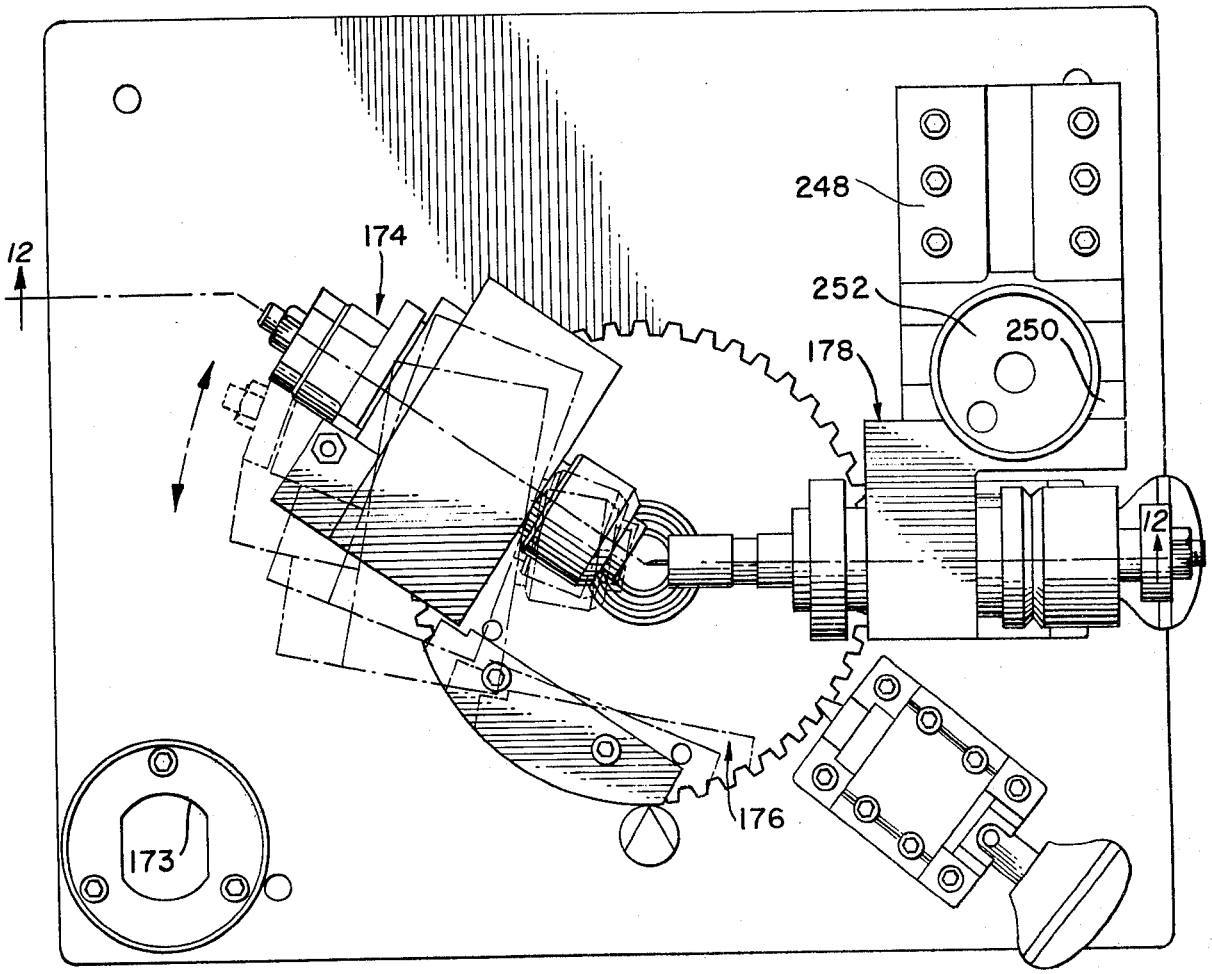
FIG. 11 is a plan view of the orifice punching apparatus of FIG. 10 with a few alternate positions illustrated in phantom lines.

Turning now to FIG. 11, the angular adjustment device 176 permits the chuck assembly 174 to move through a plurality of angular positions with respect to the punch assembly 178. To permit wide latitude in forming a preselected orifice pattern, the chuck assembly 174 is preferably mounted for movement about the axis 179 through an angle of plus or minus 60° with respect to the axis of the punch 170. In so doing, the axis of the chuck remains generally parallel to the axis of the punch 170. In addition the axis of the punch is maintained in alignment with the locus of curvature of the orifice plate blank.

The chuck assembly 174 includes a body member 180 (see FIG. 12) having a generally cylindrical bore 182 that receives a generally cylindrical bushing 184. The busing has a generally radially outwardly extending flange 186 at one axial end thereof which is engaged by a suitable latching device 188 for attachment to the body member 180.

The radial flange 186 cooperates with the locking member 188 to prevent relative rotation of the bushing 184 with respect to the body member 180 and to retain concentricity between the bushing 184 and the body member 180.

The bushing 184 also includes a cylindrical bore 190 that receives a suitable orifice blank holding device 192. The blank holding device 192 is axially positioned with respect to the bushing 184 and the body member 180 by a generally radial flange 194. A generally cylindrical bore 196 of the blank holding device receives a generally cylindrical resilient plug 198 that is backed up by a generally cylindrical metal plug 200. The metal plug 200 is adjustably positioned and includes a threaded stud that is mounted in a cap 201 which is securely connected to the blank holding device.

The resilient plug 198 comprises a resilient backing member that is disposed adjacent the orifice plate blank 111 during extrusion of holes therein by the punch 178. The resilient backing member 198 may be fabricated from polyurethane with a durometer in the range of 80 to 95 Shore A. The particular characteristics of polyurethane making it favorable for use in a punching apparatus of the present type are its toughness, resilience, machinability, durometer and plasticity. The resilient backing member 198 is operable to support an orifice plate blank 111 during a punching operation so that induced stresses are localized about a punch to thereby minimize or eliminate deformation of the blank itself. Moreover, the resilient member 198 permits the punch to project through an orifice blank to insure that an orifice is open and free from burrs and similar obstructions while simultaneously insuring that the punch itself will not be damaged.

At the end of the blank holding device 192 remote from the radial flange 194, a first collar member 202 is provided to axially support the circular flange 113 (see FIG. 6) of the orifice plate blank 111. A second collar member 204 (see FIG. 12) is coaxial with the first collar member 202 and overlaps the circular flange portion to clamp the orifice plate blank 111 in position with respect to the holding device 192. To retain the first and second sleeves 202, 204, and the orifice plate blank 111 in proper position, a sleeve 206 having a radially inwardly directed flange engaging the second sleeve 204 is threadably mounted on the end of the holding device 192. By tightening the sleeve 206, the second collar 204 can be shifted toward the first collar 202 to clamp the blank 111 therebetween.

Figure 14:
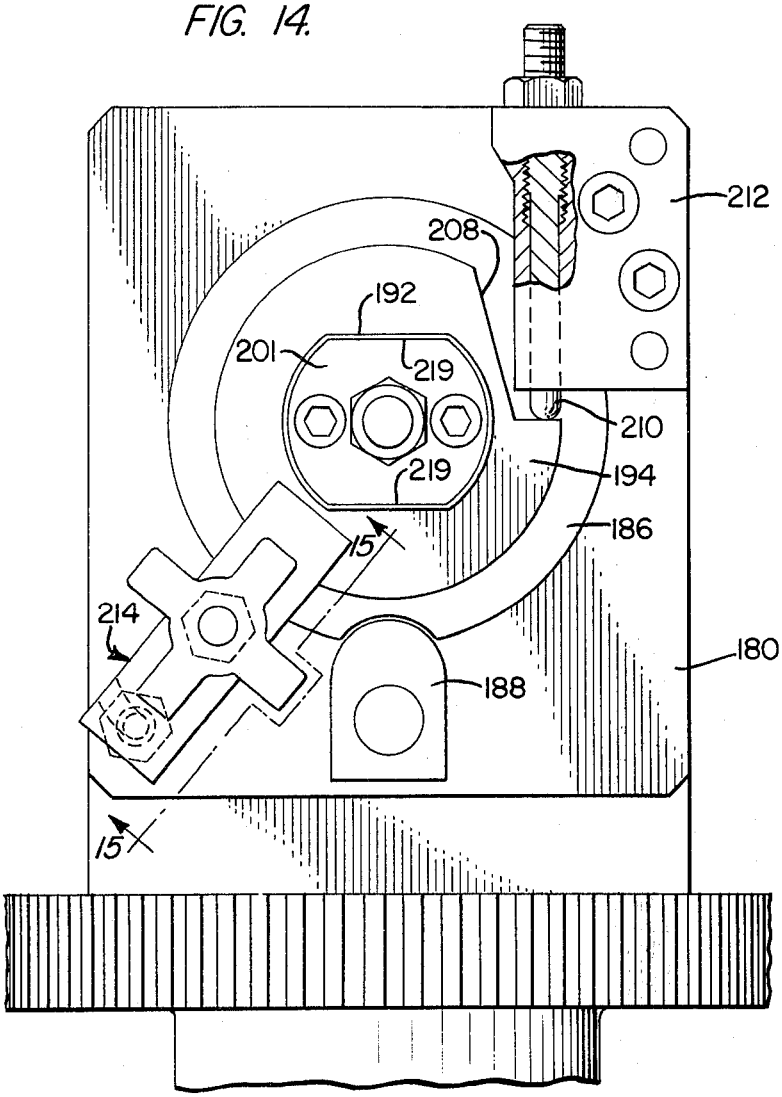
FIG. 14 is a partial end elevation of the orifice punching apparatus of FIG. 11 and illustrates the chuck retention means.

Turning now to FIG. 14, the radially extending flange 194 of the blank holding device 192 is provided with a notch 208 which is engaged by a protruding end of a positioning pin 210 carried by a block 212 that, in turn, is secured to the body member 180. The pin and notch cooperate to rotationally position the flange 194 with respect to the body member 180.

Figure 15:
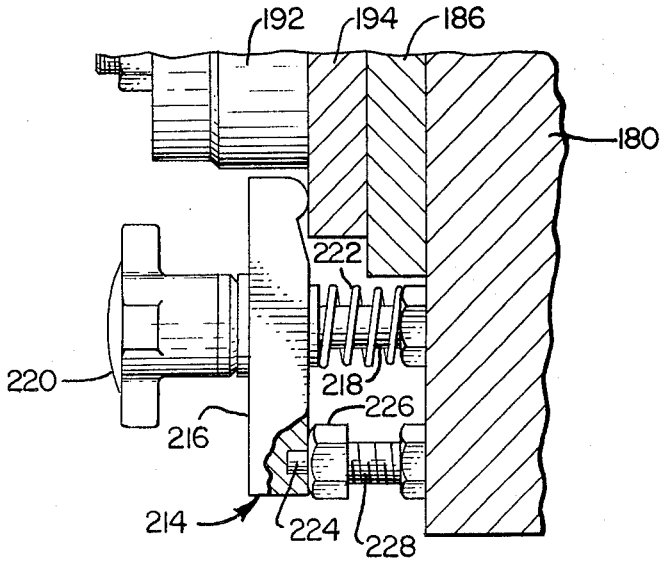
FIG. 15 is a view of the chuck retention means taken along line 15—15 of FIG. 14.

To axially retain the orifice plate holding member 192 in position with respect to the body member 180, a suitable latching device 214 is provided. Turning now to FIG. 15 the latching device 214 includes a bar 216 which is rotatably mounted about a rod 218. The rod 218 is attached at one end to the body portion 180, and is provided at the other end with a rotatable cross-shaped handle 220. Circumferentially disposed around the shaft 218 between the locking bar 216 and the body member 180 is a spring 222 which resiliently urges the locking bar away from the body member 180. Accordingly, proper rotation of the handle 220 moves one end of the locking bar 216 into and out of engagement with the radial flange 194 of the orifice holding means 192.

The other end of the locking bar 216 is supported in spaced relation to the body portion 180 by the head 226 of a screw 228. A projection 224 of the head 226 cooperates with a groove on the underside of the bar 216 to permit counterclockwise movement of the bar about the shaft 218.

From FIG. 14 it will be apparent that the end of the holding device 192 is generally circular with a pair of parallel flats 219. This end conforms with the opening 173 (see FIG. 10) of the base 172. Accordingly, when the blank holding device 192 is removed from the chuck assembly 174, the blank holding device 192 can be supported in a vertical posture by the base thereby facilitating the insertion and removal of an orifice plate blank 111.

Returning to FIG. 12, the angular adjustment means 176 preferably includes a fixed generally vertical shaft 230 which is carried by the base 172. Suitable bearings 232 may be provided around the shaft 230 and internally disposed with respect to a gear wheel 234. The lower body portion 180 of the chuck assembly 174 is securely connected to the gear wheel 234 so that the chuck assembly 174 may be positioned with respect to the base 172. From FIG. 10 it will be apparent that the gear wheel 234 is provided with a plurality of generally radially extending teeth 236 having spaces 238 interposed therebetween.

A first detent 240 is mounted on the base 172 generally beneath the punch 178 and is provided to engage the spaces 238 between gear teeth 236 and to positively position the gear wheel 234 with respect to the base 172. The first detent 240 includes (see FIG. 12) a resiliently biased plunger 242 having an end 244 that is suitably shaped to conform with the spaces 238 between adjacent gear teeth 236. Thus, the first detent 240 and the teeth 236 of the wheel 234 cooperate to angularly position the chuck assembly 174 with respect to the punch.

The end 244 of the plunger 242 is carried by a translatable and rotatable shaft 241 having a suitable knob 243 and a pair of generally radial lugs 245. By pulling the knob 243 away from the gear wheel 234, the engagement between the end 244 and a space 238 is released so that the gear wheel is free to rotate. In some instances it may be desirable to hold the end 244 out of engagement with the gear wheel 234. Accordingly, by rotating the knob 243 while the lugs 245 are out of engagement with cooperating slots of the collar 247, the lugs 245 rest on the end of the collar 247 and retain the first detent in a retracted configuration.

While the first angular detent will provide a plurality of angular locations corresponding to the number of gear teeth 236 on the gear wheel 234, it will sometimes be desirable to have an additional number of angular positions for the gear wheel 234. Accordingly, a second annular detent 246 (see FIG. 10) may be angularly disposed with respect to the first detent 240 by an angle corresponding to one half of the angle subtended by an even number of gear teeth 236. This angular relationship insures that the first angular detent 240 would be engaging the crown of a gear tooth 236 when the second annular detent 246 is engaging a space 238 between adjacent gear teeth and vice versa. The second detent 246 is in all respects similar to the first detent 240. If desired an index plate 235 may be mounted on the gear wheel 234. A suitable pointer 237 attached to the base means 172 cooperates with the index plate to indicate the angular position of the gear wheel with respect to the base 172.

The vertical adjustment device 181 (see FIG. 10) for the punch 178 includes a bracket portion 248 which is directly attached to the base 172. Slidably mounted with respect to the fixed portion 248 is a carriage portion 250 to which the punch 178 is directly attached. A sliding dovetail joint may be provided between the bracket portion 248 and the carriage portion 250 in ensure both lateral and vertical support for the punch 178. A suitable rotatable index wheel 252 is connected to a carriage raising and lowering mechanism so that the carriage portion 250 may be accurately translated with respect to the bracket portion 248 to vertically position the punch 178.

Figure 10:
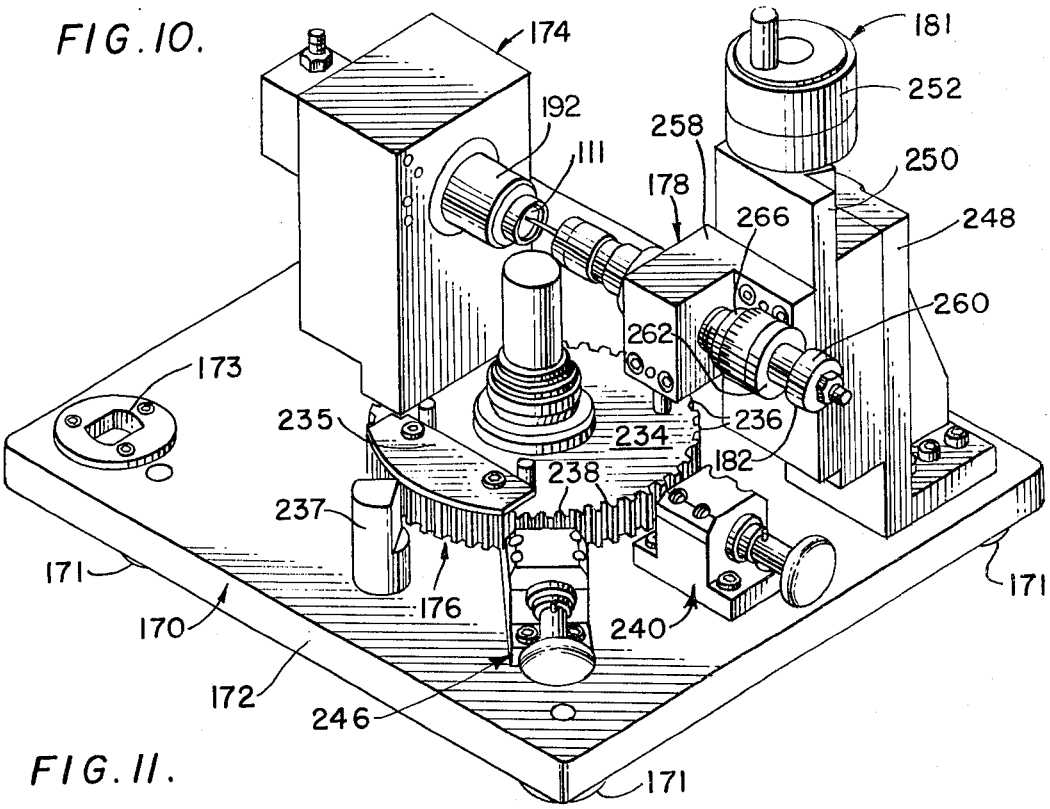
FIG. 10 is an axonometric view illustrating an orifice punching apparatus in accordance with the present invention.

The punch 178 (see FIG. 12) includes a longitudinally reciprocable generally cylindrical hollow shaft 254 which is suitably mounted in a bearing sleeve 256. A block 258 is directly mounted on the carriage assembly 250 and carries the bearing sleeve 256. One end of the shaft 254 is provided with a radially extending abutment 260 which is adapted to cooperate with an adjustable collar 262 carried by the bearing sleeve 256 and limit the longitudinal motion of the shaft 254 in the direction shown by the arrow 264 of FIG. 12. The adjustable collar 262 is provided with a jam nut 266 to lock the collar 262 in a given position. As shown in FIG. 10, the adjustable collar 262 may be provided with suitable marking to determined the depth of penetration of the punch. Thus, the collars 260, 262 and the jam nut 266 comprise the penetration adjustment device 182.

Mounted internally with respect to the reciprocating shaft 254 is a punch tool 270 having a tapered point for engaging the orifice plate blank 111 to form an orifice therein. It is preferred that the punch be conically tapered so that the depth of penetration into the orifice plate blank 111 will be a direct indication of the diameter of an orifice formed by the punching operation. Thus, in combination with the tapered punch tool 270, the penetration adjustment device 182 permits predetermination of orifice diameter and a means for providing all orifices of a blank with uniform diameters. Moreover, the penetration adjustment device 182 is effective to provide orifices of a pattern with different diameters, as specified, with a simple adjustment that does not require changing the diameter of the piercing tool.

Figure 13:
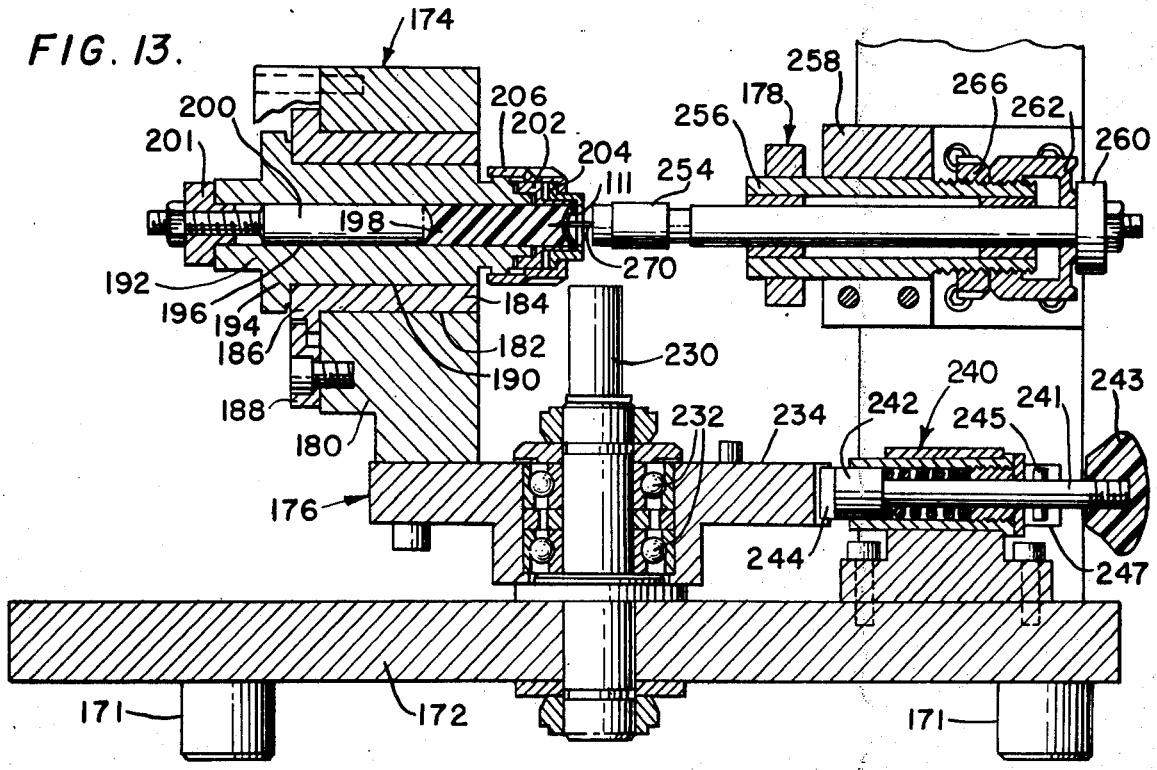
FIG. 13 is a view in partial cross-section illustrating the punching apparatus of FIG. 12 at the end of a punch stroke.

Turning now to FIG. 13, the relationship between the punch tool 270 and the reciprocating shaft 254 is illustrated when the abutment 260 has reached the limit of its movement. The punch tool 270 projects through the orifice plate 111 and into the resilient backing 198 provided adjacent thereto. As the punch tool 270 pierces the orifice plate blank, it locally deforms the blank and draws the metal in the direction of the resilient backing 198. Typically, the metal deforms plastically to define a rounded inlet to the opening made by the punch tool 270. In addition, the orifice opening is surrounded by a collar of metal which is drawn into the resilient backing as the punch tool 270 is reciprocated.

Typically, the punch tool 270 is reciprocated manually as the thin metal material does not require large forces to penetrate. Of course, the punching operation could be adapted for automatic actuation if desired.

Figure 16:
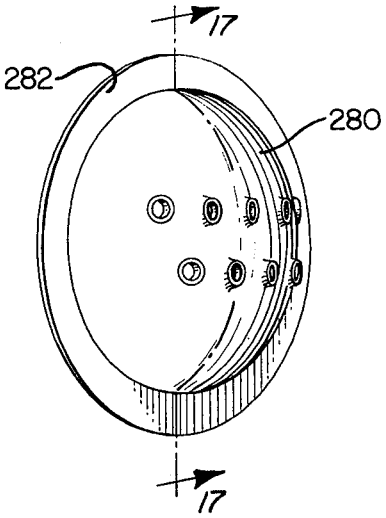
FIG. 16 is an axonometric illustration of an orifice plate having a plurality of orifices therein formed in accordance with the present invention.

A resulting orifice plate (see FIG. 16) from the above punching or extruding operation includes a compoundly curved body portion 280 having a generally circular flange 282 that provides a clamping surface making the orifice plate suitable for use in a spraying device.

Figure 17:
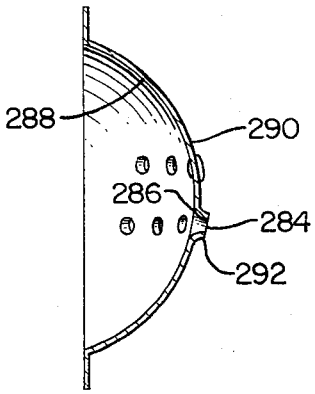
FIG. 17 is a cross-sectional view of an orifice plate of FIG. 16.

Each orifice extruded by the punching apparatus 170 described above is formed radially with respect to the locus of curvature and the rotational axis 179 (see FIG. 12), conforms with a predetermined direction and has a generally circular configuration with a longitudinal cross section similar to that depicted in FIG. 17. The specific configuration of each orifice 284 includes the rounded inlet or entrance 286 on the concave surface 288 of the orifice plate as noted above. Extending outwardly from the convex surface 290 of the orifice plate is the generally cylindrical collar or encircling projection 292 which circumscribes or surrounds each outlet 284. The outlet 284 defines an orifice opening which has a readily determined area. Moreover, the orifice opening, in combination with the encircling projection 292 provide a longer guided flow for fluids passing therethrough than is available from shorter flow passages resulting from drilled orifices. In addition, the rounded flow inlet is effective to minimize the classical vena contracta and to reduce both cavitation and the associated structural erosion as compared with sharp edged inlets.

Each orifice plate may be provided with a first row of orifices that span a predetermined angular range or arc. Preferably the orifices are uniformly spaced apart to provide a uniformly distributed efflux from the orifice plate. A second row of orifices, generally parallel to and spaced from the first row, may be provided by vertically adjusting the punch tool to a new vertical position after punching the first row. The orifices of the second row are preferably staggered with respect to orifices of the first two to optimize orifice plate spray efflux. The staggered relationship is readily effected by using the first detent to space the first row and the second detent to space the second row.

Figure 18:
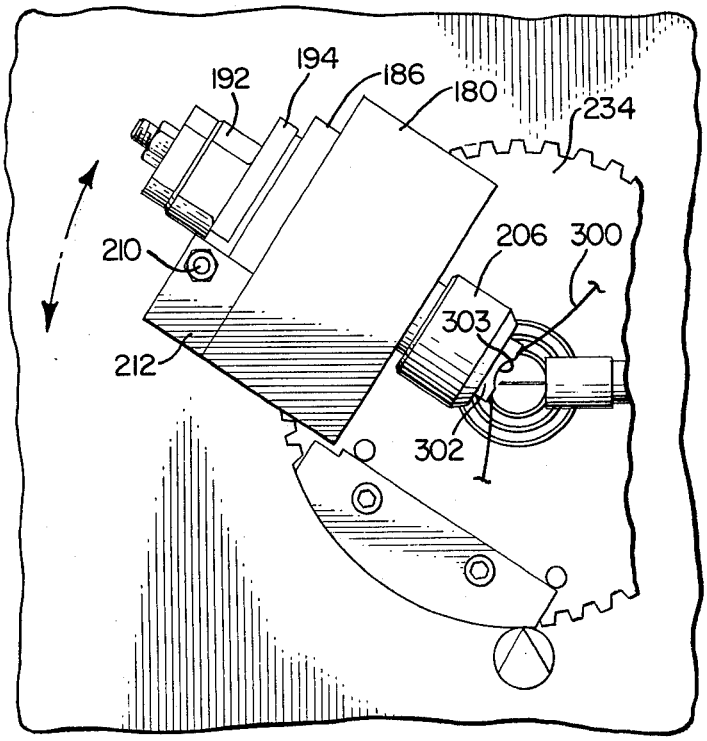
FIG. 18 is a partial plan view of the nozzle punching apparatus of FIG. 10 modified to hold a relatively continuous thin metal strip.
Figure 19:
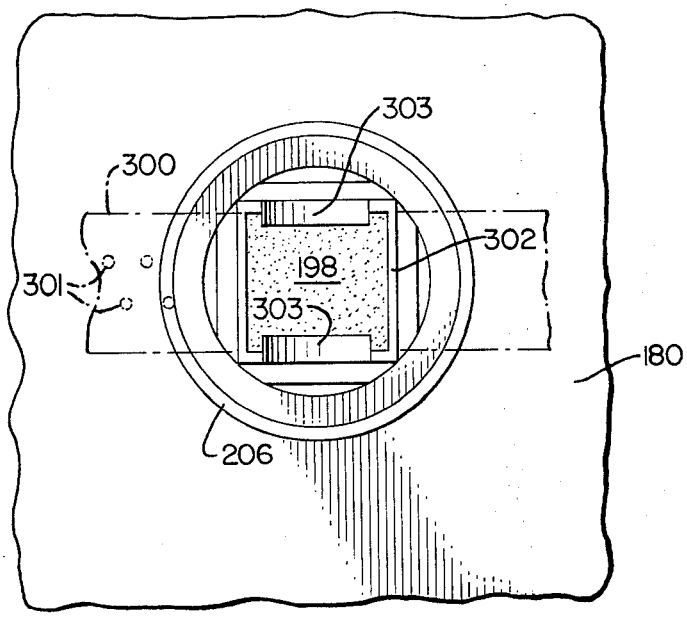
FIG. 19 is a partial elevation of the orifice holding device of FIG. 18 with the continuous strip illustrated by phantom lines for clarity.

An alternate embodiment of the punching apparatus will be seen in FIG. 18 where the orifice punching apparatus of the present invention has been adapted to punch a series of orifices 301 (see FIG. 19) in a substantially continuous thin strip 300 of metal stock and thereby form a plurality of contiguous orifice plates. By modifying the sleeves retained by the threaded sleeve 206 of the orifice holding member 129 (see FIG. 19) a thin strip 300 may be provided with a simply curved configuration. For example, an outer sleeve 302 may have a generally square or rectangular cross sectional shape that projects from the sleeve 206. By providing two sides of the sleeve 302 with arcuate internal edges 303 on two parallel sides, a continuous thin metal strip can be clamped against the resilient backing means 198 by holding parallel edges thereof between the edges 303 of sleeve 302 and the end portion of sleeve 304 such that the strip has a locus of curvature generally coincident with the rotational axis of the punching apparatus.

Figure 20:
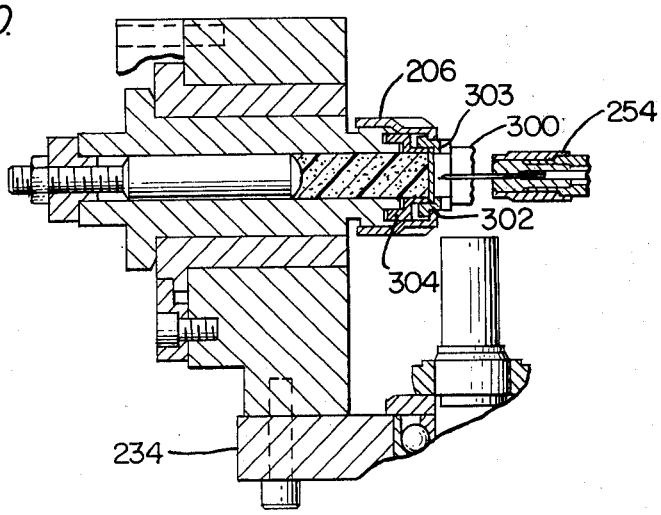
FIG. 20 is a view similar to FIG. 12 with the modification of FIG. 18 to receive a continuous metal strip.

Preferably the strip 300 is arranged in the holding sleeves 302, 304 (see FIG. 20) such that its locus of curvature is coincident with the axis of rotation of the gear wheel 234 relative to the base. In this manner, movement of the punch means 254 will extrude an orifice generally normal to the surface and having characteristics of the orifice previously described in connection with FIGS. 16 and 17.

A strip having a plurality of contiguous orifice plates may be desirable for applications where the orifice plate can be selectively advanced to replace a clogged orifice plate with a clean orifice plate. Moreover, flat orifice plates may be more readily packaged for use by unrolling when formed contiguously in a strip.

Figure 21:
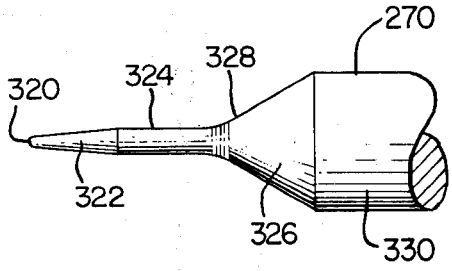
FIG. 21 is an enlarged view showing the end portion of a punch tool suitable for use with the orifice punching apparatus of FIG. 10.

Turning now to FIG. 21, a preferred embodiment of the punch tool 270 is illustrated for use when an orifice plate blank is to be provided with uniformly sized orifices. The punch tool 270 includes a rounded point 320 at the end of a tapered generally conical section 322 which may have a relatively small apex angle of approximately 11° to facilitate gradual opening of an orifice. The conical section 322 projects generally coaxially from a generally cylindrical section 324 which may be appropriately sized so that the diameter of the cylindrical section 324 conforms to the desired size of orifice to be formed in an orifice plate blank.

The cylindrical section 324 extends generally coaxially from the apex portion of a second conical section 326. A suitable fairing 328 is provided between the second conical section 326 and the cylindrical section 324 to reduce stress concentrations classically associated with sharp surface discontinuities. The second conical section 326 preferably has a larger apex angle than the first conical section 322 and is operable to transmit force from the body portion 330 of the punch tool 270 to the cylindrical section 324 and the conical section 322.

As the punch tool 270 advances and engages an orifice plate blank, the rounded end portion 320 pierces the blank. The first conical section 322 gradually opens an orifice to a predetermined diameter as the tool 270 continues to advance. The longitudinal length of the cylindrical section 324 is effective to reduce the need for precise longitudinal control of the tool 270 by virtue of the uniform diameter of that section. The cylindrical section 324 is also effective to cause burnishing of both the orifice being punched and the cylindrical section itself thereby increasing material strength and reducing frictional properties.

The configuration of a punch tool 270 is also effective to substantially increase the buckling strength thereof by virtue of the relatively larger diameter of the body portion 330 and the short small diameter punch portion. Moreover, the punch tool 270 illustrated in FIG. 21 would appear to be desirable in an automated orifice punching operation due to its decreased reliance on precise longitudinal control.

In operation a thin metal orifice plate may be manufactured by positioning an orifice plate blank 111 in a holding fixture 192 (see FIG. 10) to provide direction control of the orifice axes. Subsequently, the holding fixture 192 is mounted in a rotatable chuck assembly 174 such that the locus of curvature of the orifice plate blank 111 is generally coincident with the axis about which the chuck 174 rotates.

Then, an orifice is extruded having a rounded entrance 286 (see FIG. 17) and axis conforming with a predetermined radial direction by extending a punch 178 (see FIG. 10) transversely through the rotational axis and through the orifice plate blank 111 while the blank is resiliently supported. The resilient supporting means is operable to localize deformation of the orifice plate blank 111 which might otherwise occur when a thin plate is engaged by a sharp punch.

With the orifice extruded, the punch 178 is withdrawn from engagement with the orifice blank. In order to provide a plurality of orifices in a given orifice plate, the chuck 174 may be repositioned angularly to align the punch 178 with the other preferred angular positions. Subsequent orifices are extruded by extending the orifice plate punch transversely through the orifice plate blank and withdrawing the punch 178 from the orifice until a predetermined orifice pattern has been determined.

It is, of course, noted that the punch 178 must be aligned vertically with respect to the orifice plate blank 111 by means of the vertical adjustment 181 to provide vertically spaced orifices in the orifice plate blank if the predetermined hole pattern so requires. Similarly, the chuck assembly 174 must be angularly positioned with respect to the punch assembly 178 by the first and second detents 240, 246 to attain a predetermined angular spacing of orifices.

When a compoundly curved orifice plate is desired, an orifice plate blank 111 may be obtained by forming a spherical projection 42 (see FIG. 2) in a sheet of thin metal stock 44. Subsequently, the orifice plate blank 111 is trimmed from the sheet such that a generally circular flange 113 (see FIG. 6) circumscribes the compoundly curved portion 115 thereof.

Alternatively, an orifice plate blank comprising a strip of thin metal stock 330 (see FIG. 19) may be intermittently fed into the orifice plate holding fixture as described in the alternate embodiment. With the alternate embodiment, a plurality of contiguous orifice plate are obtained.

Preferably, a conically tapered punch is used to progressively increase the diameter of the orifice opening. Accordingly, by presetting a penetration adjustment device 182 (see FIG. 10) to a predetermined depth to which the concially tapered punch may pierce the orifice plate, the diameter of an orifice being extruded is determined.

A strip having a plurality of contiguous orifice plates, such as the product of this alternate embodiment, may be rolled up for use in a sprayer having an orifice plate that is intermittently advanced as the orifices become clogged. A strip with a plurality of orifice plates may also be desirable in terms of marketing economy since orifice plates can be handled and packaged in multiple units.

Thin orifice plates having orifices formed therein exhibit numerous advantages over previously known similar devices. For example, the simplicity of the orifice formation in addition to the available accuracy of orifice size and placement makes possible an inexpensive orifice plate which has not been available heretofore. Moreover, the inexpensive orifice plate enables operators of spraying devices to discard clogged orifice plates without incurring undue expense.

The accuracy of orifice placement in a predetermined hole pattern constitutes another desirable feature. The accurate placement of the orifice permits a nozzle to be designed for accurate and uniform dispersion of a fluid to be sprayed.

Characteristics of the orifices themselves provide further advantages for a thin orifice plate manufactured in accordance with the present invention. More specifically, the encircling projection surrounding the orifice outlet provides a guiding channel for fluid passing through the orifice plate which channel is longer than otherwise available from conventionally manufactured orifices and which channel provides directional control needed to enable orifices to conform with predetermined directions.

The rounded entrance to the generally circular orifices also exhibits desirable and useful features. For example, the rounded inlet eliminates sharp edges which result from conventional manufacturing processes. Such sharp edges are subject to rapid erosion by fluid passing therearound. The rounded inlet of the orifices of the present invention eliminate the problem of wear by presenting a larger surface area and by reducing the severity of flow direction changes.

The rounded inlet also reduces the effect of a classical vena contracta in determining volumetric flow capacity of an orifice. Accordingly, the exit area of the orifice is the controlling area for flow calculation purposes and, therefore, there is no need to apply empirical area reduction factors.

The size of the punching apparatus, its accuracy and wide range of adjustable features, make the punching apparatus a highly desirable device for those in the business of manufacturing thin orifice plates. Moreover, the elimination of small diameter, easily broken, expensive drills, facilitates the production of an inexpensive orifice plate. The vertical, angular, and penetration adjustment features provided enable a wide spectrum of orifice patterns having either uniform or varied orifice diamters, to be readily manufactured by a single piece of equipment without changing orifice forming tools during manufacture.

It should now be apparent that there has been provided in accordance with the above described novel apparatus a novel method of manufacturing a novel orifice plate. It will be apparent to those skilled in the art that many modifications, variations, substitutions and equivalents for the steps and apparatus disclosed and described would also provide the desired result. Accordingly, it is expressly intended that all such modifications, variations, substitutions, and equivalents which are within the spirit and scope of the invention as defined in the appended claims be embraced thereby.

What is claimed is:

1. A method of manufacturing a thin metal orifice plate having an orifice therethrough comprising the steps of:

positioning an orifice plate blank having a thickness between 0.001 and 0.010 inches in a holding fixture;

supporting at least a portion of the orifice plate blank in the holding fixture with a resilient member;

piercing a generally circular orifice in the resiliently supported portion of the orifice plate blank with a transversely operable punch;

further extending the punch transversely through the resiliently supported portion of the orifice plate blank and into the resilient member so as to localize deformation stresses during formation of the generally circular orifice having a rounded inlet and an outlet circumscribed by an encircling projection extending from the rounded inlet.

2. A method of manufacturing a thin metal orifice plate having a plurality of orifices accurately conforming with predetermined directions comprising the steps of:

positioning an orifice plate blank in a holding fixture to aid directional control of orifices axes;

backing at least a portion of the orifice plate blank with a resilient member;

mounting the holding fixture and a punch for adjustable movement relative to one another about a rotational axis spaced from the orifice plate blank and spaced from the holding fixture; and piercing and subsequently extruding each of a plurality of orifices by extending a punch transversely through the rotational axis while the resiliently backed portion of the orifice plate blank has localized deformation so that each orifice has a rounded inlet and an outlet circumscribed by an encircling projection the axis of which conforms to one of the predetermined directions.

3. The method of claim 2 further including the step of forming a curved orifices in the orifice plate blank while the orifice plate blank is held by the holding fixture such that a locus of curvature of the blank lies on the rotational axis.

4. A method of manufacturing a thin-sheet orifice plate having orifices with axes accurately conforming with predetermined directions, comprising:

positioning an orifice plate blank having a locus of curvature in a jig to aid directional control of orifice axes;

rotatably mounting the jig about an axis such that the locus of curvature of the orifice plate blank coincides with the rotational axis of the jig;

extruding at least one orifice having a rounded entrance and an axis conforming with a predetermined direction in the orifice plate blank by extending a punch transversely through the rotational axis and through the orifice plate blank while resiliently supporting the orifice plate blank to localize deformation thereof; and withdrawing the punch from engagement with the orifice plate blank.

5. The method of claim 4 including the steps of:

repositioning the jig to align the punch with a desired location for another orifice;

extruding another orifice in the orifice plate blank by extending the punch transversely through the rotational axis;

withdrawing the punch from the orifice; and repeating the repositioning, extruding, and withdrawing steps until a predetermined hole pattern is obtained.

6. The method of claim 4 wherein the extruding step includes:

aligning the punch vertically with respect to the orifice plate blank to provide vertically spaced orifices in the orifice plate blank; and angularly orienting the jig with respect to the punch to attain predetermined angular spacing of orifices in the orifice plate blank.

7. A method of manufacturing a thin-sheet orifice plate having orifices with axes accurately conforming with predetermined directions, comprising:

positioning an orifice plate blank having a locus of curvature in a jig to aid directional control of orifice axes;

rotatably mounting the jig about an axis such that the locus of curvature of the orifice plate blank coincides with the rotational axis of the jig;

extruding at least one orifice having a rounded entrance and an axis conforming with a predetermined direction in the orifice plate blank by extending a punch transversely through the rotational axis and through the orifice plate blank while resiliently supporting the orifice plate blank to localize deformation thereof;

withdrawing the punch from engagement with the orifice plate blank; and including the prior steps of forming a spherical projection in a sheet of thin metal stock to define a spherical portion of an orifice plate blank, and trimming from the sheet an orifice plate blank having a generally circular flange circumscribing a spherical projection.

8. The method of claim 4 including the prior step of:

intermittently feeding a continuous strip of thin metal stock as an orifice plate blank to the holding fixture to obtain a plurality of contiguous orifice plates.

9. The method of claim 4 wherein the extruding step includes:

piercing the orifice plate blank with a conically tapered punch to progressively increase the diameter of an orifice opening.

10. The method of claim 9 including:

presetting a predetermined depth to which the conically tapered punch may pierce the orifice plate blank to determine the diameter of the orifice being extruded.

11. A thin metal orifice plate manufactured by the method of claim 4 and including a plurality of spaced orifices having rounded inlets and axes conforming to predetermined directions.

12. A method of fabricating a nozzle orifice plate suitable for promoting the formation of uniformly-sized fluid droplets and providing radial streams of droplets accurately following predetermined directions as the droplets and streams thereof emanate from the nozzle orifice plate, comprising:

positioning individual orifices of a thin metal orifice plate at predetermined locations corresponding to the predetermined directions; and aligning a tapered punch with a locus of curvature of the orifice plate to ensure the radial positioning of each orifice;

piercing the orifice plate with the punch while the orifice plate is supported by a resilient backing material such that a rounded orifice entrance is obtained; and stopping the piercing movement of the punch at a predetermined depth to provide a uniform diameter for each orifice and to obtain an outwardly extending encircling projection for directing a fluid stream along a direction colinear with the axis of the punch.

13. Punching apparatus for making an orifice in a thin metal orifice sheet blank having a thickness between 0.001 and 0.010 inches comprising:

base means;

chuck means operably carried by the base means for securely holding an orifice plate blank while an orifice is formed therein;

resilient backing means carried by the chuck means, disposed adjacent to an orifice plate blank and operable to localize stresses in an orifice plate blank when an orifice is formed therein;

punch means mounted on the base means operable to pierce an orifice plate blank carried by the chuck means and to form a generally circular orifice having a rounded inlet and an outlet circumscribed by an encircling projection extending from the rounded inlet.

14. Punching apparatus for making a plurality of orifices in a thin, metal, compoundly curved orifice plate blank, the punching apparatus comprising:

base means;

chuck means operably carried by the base means for securely holding an orifice plate blank while orifices are formed therein;

resilient backing means carried by the chuck means, disposed adjacent to an orifice plate blank and operable to localize stresses in an orifice plate blank while orifices are formed therein;

punch means operably mounted on the base means, having a longitudinal axis, and being operable to radially pierce an orifice plate blank carried by the chuck means;

positioning means operably connected to the base means for controlling the relative position between chuck means and the punch means, having a plurality of positions to permit a predetermined orifice pattern to be obtained.

15. The punching apparatus of claim 14 wherein the positioning means includes vertical adjustment means attached to the punch means and operable to position the punch means vertically with respect to the chuck means.

16. The punching apparatus of claim 14 wherein the positioning means includes angular adjustment means rotatably carried by the base means, having a rotational axis passing through a locus of curvature of the orifice plate blank carried by the chuck means, carrying the chuck means, and operable to angularly position the chuck means with respect to the punch means.

17. Punching apparatus for making uniformly sized orifices having predetermined radial orientation in a thin metal orifice plate comprising:

base means;

chuck means for securely holding an orifice plate blank having a center of curvature while orifices are formed therein;

resilient backing means carried by the chuck means, disposed adjacent to an orifice plate blank and operable to localize stresses in an orifice plate blank when orifices are formed therein;

punch means mounted on the base means, having a longitudinal axis passing through the rotational axis, and being operable to radially pierce an orifice blank carried by the chuck means;

angular adjustment means rotatably carried by the base means, having a rotational axis passing through a center of curvature of an orifice plate blank carried by the chuck means, and being operable to relatively angularly re-position the chuck means and said punch means;

vertical adjustment means being attached to the punch means and operable to position the punch means vertically with respect to the chuck means; and penetration adjustment means disposed at one end of the punch means, being operable to control the depth which the punch means projects into the orifice plate blank and being operable to predetermine the diameter of an orifice formed by the punch means.

18. The punching apparatus of claim 17 wherein:

the punch means includes a reciprocable conically pointed punch tool for piercing an orifice plate blank and opening an orifice of predetermined diameter therein, the pointed punch tool having longitudinal axis passing through the rotational axis.

19. The punch apparatus of claim 17 wherein the angular adjustment means comprises:

a wheel having a plurality of radially outwardly extending gear teeth having spaces therebetween, being rotatably mounted on the base means and, carrying the chuck means; and a first radially oriented detent means carried by the base means, selectively engageable with the peripheral spaces of the wheel, and operable to retain the chuck means in a plurality of angular positions with respect to the punching means.

20. The punching apparatus of claim 17 wherein the angular adjustment means further includes:

a second radially oriented detent means carried by the base means, angularly spaced from the first detent means by an angle corresponding to one half of the central angle subtended by an even number of the gear teeth, selectively engageable with the peripheral spaces of the wheel, and operable to retain the chuck means in a plurality of angular positions each of which is interposed between two angular positions provided by the first detent means.

21. The punching apparatus of claim 17 wherein the punch means includes a punch tool comprising:

a first conical portion having a rounded point being operable to pierce an orifice plate blank and open an orifice therein;

a generally cylindrical portion connected to the first conical portion, having a diameter corresponding to the predetermined diameter of an orifice and being operable to burnish an orifice while forming the orifice;

a second generally conical portion from which the generally cylindrical portion extends; and a body portion from which the second conical portion extends, being operable to translate the first conical portion and the cylindrical portion into and out of engagement with the orifice plate blank.

* * * * *